US006405400B1

(12) United States Patent
McClain

(10) Patent No.: US 6,405,400 B1
(45) Date of Patent: Jun. 18, 2002

(54) PERSONAL FOOT SCRUBBER

(76) Inventor: William Edward McClain, 91 C Polipoli Rd., Kula, HI (US) 96790

( * ) Notice: Subject to any disclaimer, the term of this patent is extended or adjusted under 35 U.S.C. 154(b) by 0 days.

(21) Appl. No.: 09/596,685

(22) Filed: Jun. 19, 2000

Related U.S. Application Data

(60) Provisional application No. 60/154,232, filed on Sep. 16, 1999.

(51) Int. Cl.[7] ..... A47K 7/02

(52) U.S. Cl. ..... 15/160; 15/161; 4/606; 601/136; D4/130; D28/63

(58) Field of Search ..... 15/104.92, 160, 15/161; 4/606; 601/136; D4/124, 130, 137; D28/63

(56) References Cited

U.S. PATENT DOCUMENTS 1,954,940 A * 4/1934 Mikel ..... 15/160 X
2,591,331 A * 4/1952 Baumbach ..... 15/160
3,543,747 A * 12/1970 Gustafson ..... 15/160 X
D260,563 S * 9/1981 Walsh, Jr. ..... D28/63
4,617,917 A * 10/1986 Miller ..... 15/160 X
4,704,759 A * 11/1987 Mesa ..... 15/160
D324,778 S * 3/1992 Whittington ..... D28/63 X
5,228,165 A * 7/1993 Westberry et al. ..... 15/160
D363,378 S * 10/1995 Fredricks ..... D4/130
5,729,858 A * 3/1998 Riffel ..... 15/160 X
5,813,078 A * 9/1998 Hogan, Sr. ..... 15/160
D425,707 S * 3/2000 Olsson ..... D4/130 X
6,253,407 B1 * 7/2001 Bjelkevig ..... 15/160

* cited by examiner

*Primary Examiner*—Mark Spisich

(57) ABSTRACT

A personal foot scrubber of multiple uses. Consists of a singular unit of one piece construction, which has a plurality of suction cups on the lower base surface, which can be affixed to a bathtub, shower floor or wall or any other smooth surface. A plurality of bristles clusters extend upward from upper base surface for which to scrub or massage feet, hands, other body parts and other accepting surfaces.

1 Claim, 3 Drawing Sheets

PERSONAL FOOT SCRUBBER

PRIOR APPLICATION

This application claims benefit of provisional application No. 60/154,232, filed Sep. 16, 1999.

BACKGROUND OF INVENTION

1. Technical Field

The invention relates generally to the field of brushes for bathing. More specifically, to a brush which can be removably attached by its suction cups to a bathtub, shower floor or wall. To be used while sitting or standing, for cleaning feet or other parts of the body.

2. Description of Prior Art

There are brushes for scrubbing feet and brushes for scrubbing other parts of the body and many of these have a base with suction cups. There are brushes for cleaning the bottom of shoes and for cleaning food products. What sets my foot scrubber apart from others of this type are the following design enhancements: flexibility, mountability, portability and cleanability.

The object of this invention firstly serves as a personal foot scrubber and massage device, which allows the user to sit or stand while using. A healthy person of any age can use it and the elderly and disabled can benefit from the sense of well being one can achieve by self massage and the feeling of independence one feels when taking care of one's personal hygiene.

Secondly, the design construction and material used allows for many other uses for the personal foot scrubber design. Other brushes are limited in use by size, weight, construction and materials, including the following U.S. Pat. No. 5,813,078, U.S. Pat. No. 5,729,585, U.S. Pat. No. DES. 363,378, U.S. Pat. No. 4,617,917, U.S. Pat. No. 3,543,747 and U.S. Pat. No. 2,591,331. These scrubbers seem cumbersome, inflexible and by design limited to use on feet and/or hands.

BEST METHOD OF CARRYING OUT THE INVENTION

Figure 1A:
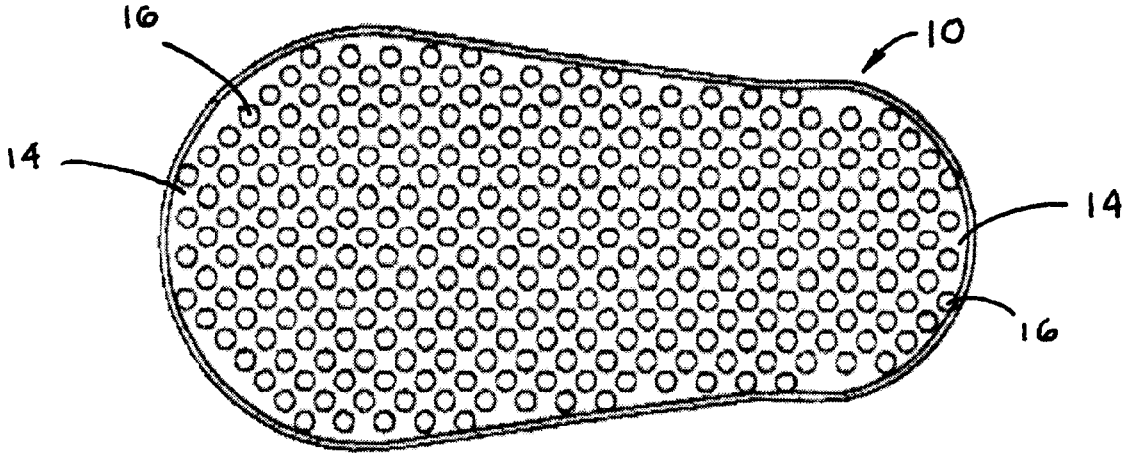
FIG. 1A is a top plan view of a foot scrubber with a variety of uses.

The personal foot scrubber 10 as shown in FIGS. 1–8, is comprised of the following major elements: a base 12, bristle clusters 16, suction cups 20, small circular recessed cavities 22, and large circular recessed cavities 24.

Figure 7:
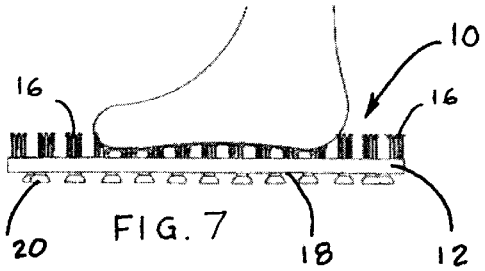
FIG. 7 is a side view with a foot on the bristle-scrubbing surface thereof.

FIG. 7 shows the scrubber 10 attached to a tub or shower by suction cups 20 floor with a foot resting on the top surface 14 with the resilient bristle clusters 16 pushing up against the arch and entire surface of the bottom of the foot.

Figure 1B:
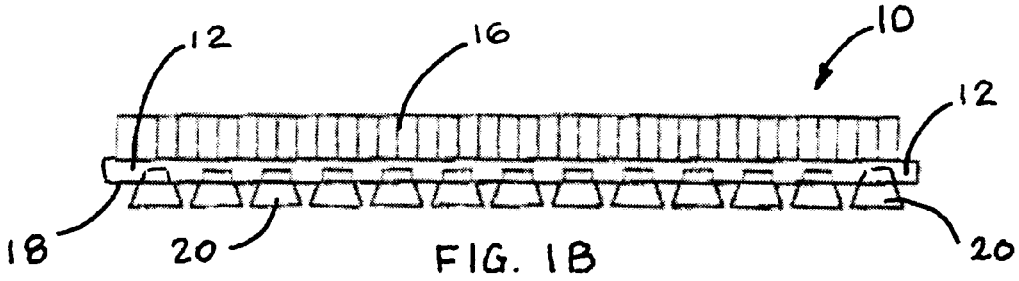
FIG. 1B is a side plan view of a foot scrubber which shows a multiplicity of bristle clusters on the top plurality of suction cups on bottom.
Figure 1C:
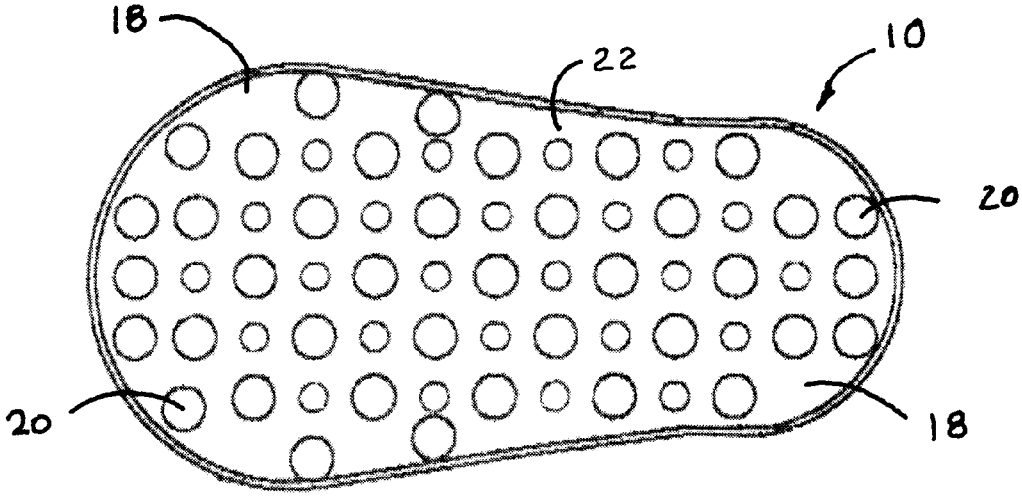
FIG. 1C is a bottom plan view of a foot scrubber with a plurality of suctions cups and a number of small and large circular recessed cavities whose purposes will be explained later.
Figure 5:
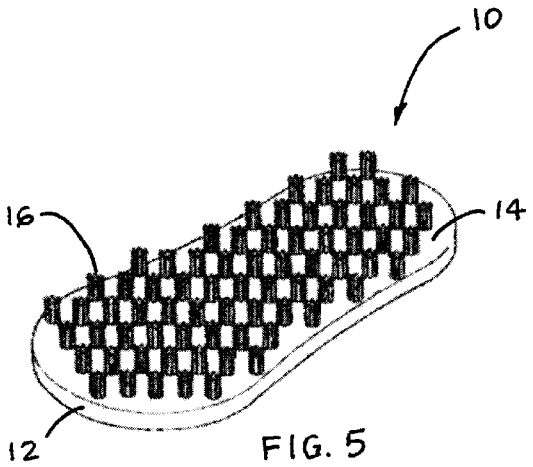
FIG. 5 is a top and side elevation view thereof.
Figure 3:
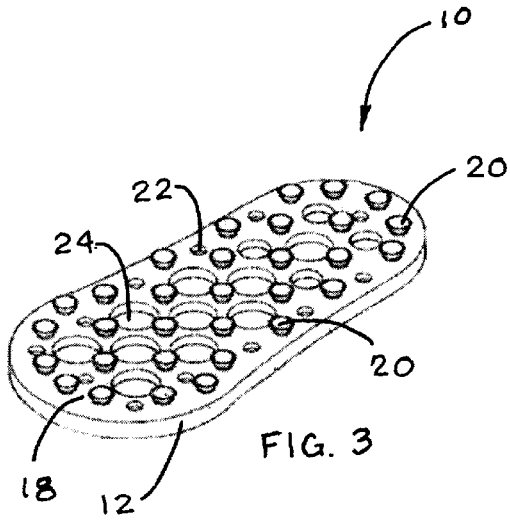
FIG. 3 is a bottom view and side elevation view thereof.
Figure 4:
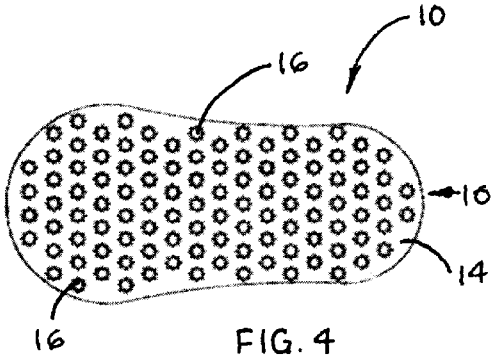
FIG. 4 is a top (front on left-hand side and rear on right-hand side) view thereof.
Figure 2:
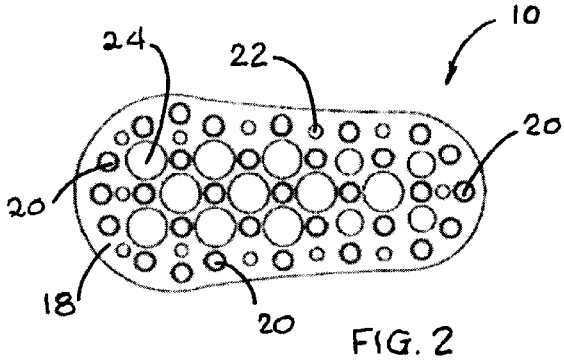
FIG. 2 is a bottom view, the front on the left-hand side and the rear on the right-hand side thereof.
Figure 8:
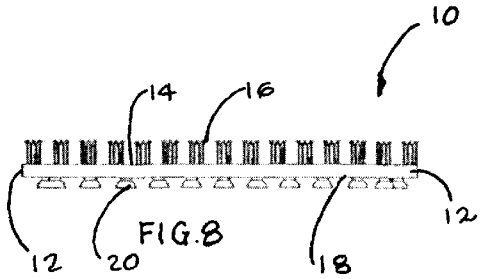
FIG. 8 is a side view showing bristles, base and suction cups thereof.
Figure 6:
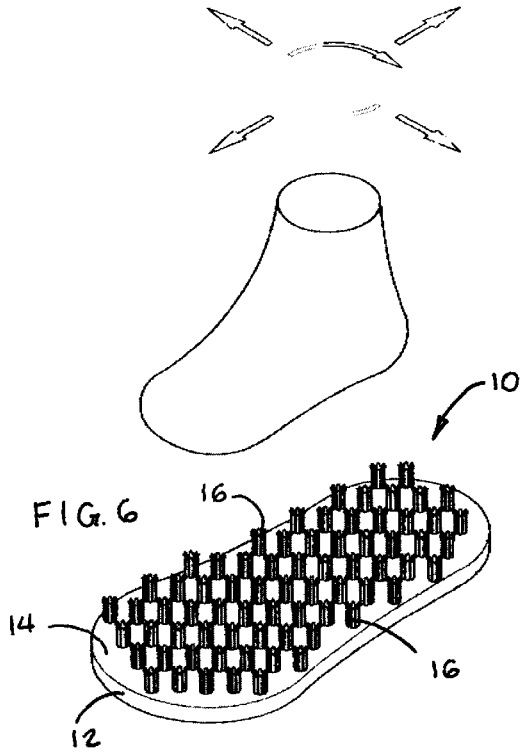
FIG. 6 is a top and side elevation view showing a foot descending on the foot scrubber thereof.

FIG. 6 shows a suggested method of self-cleaning and massage. Once the foot is lowered onto the top surface 14 and bristle clusters 16 of the affixed scrubber 10 the foot is moved from side to side, back and forth and in a circular movement for optimum effect FIG. 1B shows a side view of the scrubber 10. By design, the base 12 is lightweight and flexible so the suction cups 20 on the bottom surface 18 can be affixed to any vertical surface for quick drying and storage. In addition the base 12 is flexible enough to be folded back onto it self. The bottom surface 18 can be held in a hand and the top surface 14 with its bristle clusters 16 can be manipulated around and across other body parts and other accepting even or uneven surfaces.

DISCLOSURE OF THE INVENTION

The flexible PVC bristle clusters consist of rounded fingers. Brushes of this nature are used with water, hence the potential for mold and mildew. Because of one-piece seamless construction my invention is less likely to mold or mildew than other brushes. The seamless construction also eliminates bonds and glues that can separate and deteriorate.

My invention has two sizes of circular recessed cavities on the bottom suction cup side. The recesses enhance flexibility and significantly reduce the weight of the unit.

Flexibility and weight (lb. per device) allows for mountability and portability. The personal foot scrubber base suction cups adhere to any smooth surface. Shower or bath tub floor, sink, and counter top. In this mode almost anything can be rubbed against the bristle clusters for cleaning and massage.

Flexibility means the scrubber can be hand held and used to rub against and thereby clean and massage any part of the body and for that matter any other suitable object.

Mountability means the personal scrubber can be affixed not only to the shower or tub floor, but also to the shower wall or tub side or any other smooth surface. This allows for faster draining and drying and an expansion of uses.

Portability means, that because of size and weight, the scrubber can be easily relocated and even traveled with. The scrubber fits into any standard one-gallon plastic storage bag.

Cleanability means no seams, therefore less mold build up, quick draining and drying. Size, weight and material allows for cleaning in the dish washer or washing machine if necessary.

What is claimed is:

1. A foot scrubber comprising:

a substantially planar base having top and bottom surfaces, the bottom surface of the base including a plurality of recessed cavities which terminate below the top surface of the base, a plurality of bristle clusters extending from the top surface of the base, each of the bristle clusters including a plurality of bristles in a generally circular arrangement;

a plurality of suction cups extending from the bottom surface of the base and distributed among the recessed cavities;

wherein the base, bristle clusters and the suction cups are integrally formed from molded plastic; and whereby the base may be secured to a support surface with the suction cups and the user may scrub and massage his or her feet by moving their foot across said bristle clusters.

* * * * *